US009835999B2

(12) United States Patent
Tsuda et al.

(10) Patent No.: US 9,835,999 B2
(45) Date of Patent: Dec. 5, 2017

(54) IMAGE FORMING APPARATUS INCLUDING FORMING UNIT CAPABLE OF FORMING TRANSFER-OBJECT IMAGE AND PATCH IMAGE

(71) Applicant: FUJI XEROX CO., LTD., Tokyo (JP)

(72) Inventors: Yu Tsuda, Kanagawa (JP); Yasunori Unagida, Kanagawa (JP); Kanji Watanabe, Kanagawa (JP); Yuji Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/166,559

(22) Filed: May 27, 2016

(65) Prior Publication Data

US 2017/0185022 A1 Jun. 29, 2017

(30) Foreign Application Priority Data

Dec. 25, 2015 (JP) ..... 2015-254491

(51) Int. Cl.

*G03G 15/00* (2006.01)
*G03G 15/01* (2006.01)
*G03G 21/00* (2006.01)

(52) U.S. Cl.

CPC ..... *G03G 15/50* (2013.01); *G03G 15/01* (2013.01); *G03G 15/5058* (2013.01); *G03G 21/0041* (2013.01)

(58) Field of Classification Search

CPC .... G03G 15/50; G03G 15/01; G03G 15/5058; G03G 15/6517; G03G 21/0041; G03G 2215/00063; G03G 2215/00059; G03G 2215/0161

USPC ..... 399/49, 71, 72, 343

See application file for complete search history.

(56) References Cited

U.S. PATENT DOCUMENTS

2006/0093409 A1* 5/2006 Kyung ..... G03G 15/50 399/299
2007/0116483 A1* 5/2007 Kobayashi ..... G03G 15/0131 399/49
2008/0292338 A1* 11/2008 Fujiwara ..... G03G 15/0131 399/49
2011/0222885 A1* 9/2011 Yamaki ..... G03G 15/0131 399/72

(Continued)

FOREIGN PATENT DOCUMENTS

JP 2011-64715 A 3/2011

*Primary Examiner* — Sophia S Chen

(74) *Attorney, Agent, or Firm* — Sughrue Mion, PLLC

(57) ABSTRACT

An image forming apparatus includes a photosensitive member having first and second areas at different positions at an axial end of the photosensitive member, the first and second areas not overlapping an image area in an axial direction of the photosensitive member; a detecting unit that detects an image; and a forming unit that forms a transfer-object image in the image area, the transfer-object image being transferred to a transfer area of continuous-form paper, the forming unit further forming first and second images in the first and second areas of the photosensitive member, respectively, the first image not being transferred to the transfer area but being detected by the detecting unit for use in an operation of controlling conditions for image formation, the second image not being transferred to the transfer area and not being used in the operation of controlling the conditions for image formation.

10 Claims, 6 Drawing Sheets

(56) References Cited

U.S. PATENT DOCUMENTS

2015/0071671 A1* 3/2015 Kiuchi ..... G03G 15/5062
399/72

* cited by examiner

IMAGE FORMING APPARATUS INCLUDING FORMING UNIT CAPABLE OF FORMING TRANSFER-OBJECT IMAGE AND PATCH IMAGE

CROSS-REFERENCE TO RELATED APPLICATIONS

This application is based on and claims priority under 35 USC 119 from Japanese Patent Application No. 2015-254491 filed Dec. 25, 2015.

BACKGROUND

Technical Field

The present invention relates to an image forming apparatus.

SUMMARY

According to an aspect of the invention, there is provided an image forming apparatus including a photosensitive member having an image area, a first area, and a second area, the first and second areas being provided at different predetermined positions, respectively, at an axial end of the photosensitive member, the first and second areas not overlapping the image area in an axial direction of the photosensitive member; a detecting unit that detects an image; and a forming unit that forms a transfer-object image in the image area of the photosensitive member, the transfer-object image being transferred to a transfer area of continuous-form paper, the forming unit further forming a first image in the first area of the photosensitive member and a second image in the second area of the photosensitive member, the first image not being transferred to the transfer area of the continuous-form paper, the first image being detected by the detecting unit and being used in an operation of controlling conditions for image formation, the second image not being transferred to the transfer area of the continuous-form paper and not being used in the operation of controlling the conditions for image formation.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will now be described with reference to the accompanying drawings, wherein an arrow H represents the vertical direction, and an arrow W represents the horizontal direction corresponding to the widthwise direction of the apparatus (hereinafter referred to as "the apparatus-width direction").

Configuration of Image Forming Apparatus 10

Figure 1:
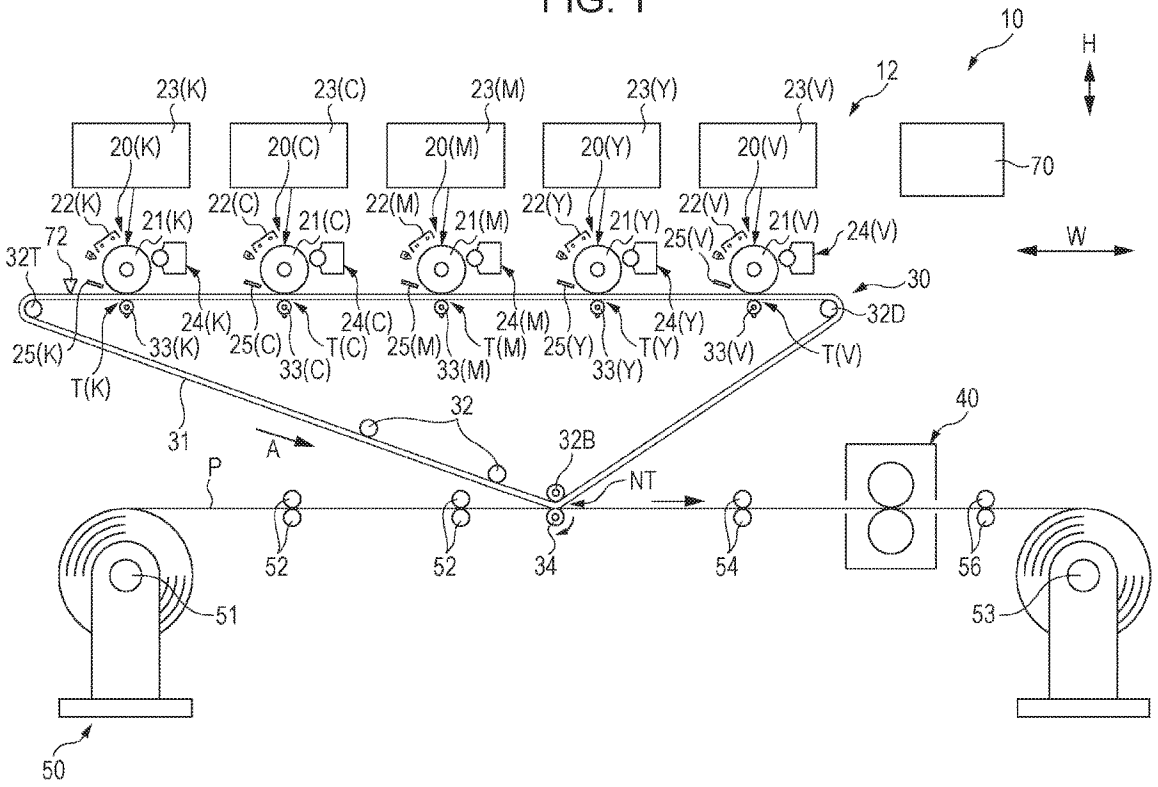
FIG. 1 is a schematic diagram illustrating a configuration of an image forming apparatus, seen from the front side, according to the exemplary embodiment.

FIG. 1 is a schematic diagram illustrating a configuration of an image forming apparatus 10, seen from the front side, according to the exemplary embodiment. As illustrated in FIG. 1, the image forming apparatus 10 includes an image forming section 12 that electrophotographically forms an image on continuous-form paper P such as a label sheet, a transporting device 50 that transports the continuous-form paper P, and a controller 70 that controls operations of relevant elements included in the image forming apparatus 10.

Transporting Device 50

As illustrated in FIG. 1, the transporting device 50 includes a feed roller 51 from which a roll of continuous-form paper P is unwound, a winding roller 53 on which the unwound continuous-form paper P is wound, and a continuous portion (not illustrated). When the transporting device 50 is activated, the feed roller 51 and the winding roller 53 are rotated, whereby the winding roller 53 winds up the continuous-form paper P while the feed roller 51 unwinds the roll of continuous-form paper P.

Pairs of transport rollers 52 transport the continuous-form paper P from the feed roller 51 to a second-transfer position NT. A pair of transport rollers 54 transport the continuous-form paper P from the second-transfer position NT to a fixing device 40. A pair of transport rollers 56 transport the continuous-form paper P from the fixing device 40 to the winding roller 53.

Image Forming Section 12

The image forming section 12 includes toner-image-forming units 20 that form respective toner images, a transfer device 30 that transfers the toner images formed by the toner-image-forming units 20 to the continuous-form paper P, and the fixing device 40 that fixes the toner images on the continuous-form paper P by applying heat and pressure thereto.

The toner-image-forming units 20 form toner images in different colors. In the present exemplary embodiment, five toner-image-forming units 20 are provided for five colors of yellow (Y), magenta (M), cyan (C), black (K), and a special color (V). The toner-image-forming units 20 are arranged side by side in order of that for the special color (V), that for yellow (Y), that for magenta (M), that for cyan (C), and that for black (K) from the upstream side toward the downstream side in the direction of rotation of a transfer belt 31, which will be described later.

Suffixes (V), (Y), (M), (C), and (K) given to some reference numerals in FIG. 1 indicate the respective colors for which elements denoted by those reference numerals are provided. The special color (V) is, for example, silver or gold.

Toner-Image-Forming Unit 20

The toner-image-forming units 20 basically have the same configuration, except the kinds of toner to be used. Specifically, referring to FIG. 2, the toner-image-forming units 20 each include a photoconductor drum 21 (an exemplary photosensitive member) that rotates clockwise in FIG. 2, a charger 22 that charges the photoconductor drum 21, an exposure device 23 that exposes the photoconductor drum 21 charged by the charger 22 to light and thus forms an electrostatic latent image on the photoconductor drum 21, a developing device 24 that develops the electrostatic latent image formed on the photoconductor drum 21 by the exposure device 23 and thus forms a toner image, and a blade 25 as a removal member that removes residual toner particles from the surface of the photoconductor drum 21 having undergone the transfer of the toner image to the transfer device 30.

The charger 22 charges the surface (a photosensitive layer) of the photoconductor drum 21 to have, for example, negative polarity. The negatively charged surface of the photoconductor drum 21 is exposed to exposure light L emitted from the exposure device 23. The exposed part of the photoconductor drum 21 comes to have positive polarity, whereby an electrostatic latent image is formed on the surface of the photoconductor drum 21. Toner in the developing device 24 is triboelectrically charged to have negative polarity. The negatively charged toner is attracted to the positively charged electrostatic latent image, whereby the electrostatic latent image is developed. In this manner, a toner image is formed on the surface (the outer peripheral surface) of the photoconductor drum 21. Thus, in the present exemplary embodiment, a combination of the charger 22, the exposure device 23, and the developing device 24 serves as an exemplary forming unit that forms a toner image on the photoconductor drum 21. The blade 25 is in contact with the surface of the photoconductor drum 21 and thus scrapes residual toner particles off the surface of the photoconductor drum 21.

Transfer Device 30

The transfer device 30 transfers, in first transfer, the toner images formed on the respective photoconductor drums 21 to the transfer belt 31 (an intermediate transfer body) such that the toner images are superposed one on top of another, and further transfers, in second transfer, the set of toner images superposed on the transfer belt 31 to the continuous-form paper P at the second-transfer position NT (an exemplary transfer nip). Specifically, as illustrated in FIG. 1, the transfer device 30 includes the transfer belt 31, first-transfer rollers 33, and a second-transfer roller 34.

Transfer Belt 31

Referring to FIG. 1, the transfer belt 31 has an endless shape and is positioned by being stretched around plural rollers 32. In the present exemplary embodiment, the transfer belt 31 has an inverted obtuse-triangular shape in front view with the base thereof extending in the apparatus-width direction. Among the plural rollers 32 illustrated in FIG. 1, the roller 32D serves as a driving roller that is driven by a motor (not illustrated) and thus rotates the transfer belt 31 in a direction indicated by an arrow A. The transfer belt 31 transports the toner images transferred thereto in the first transfer to the second-transfer position NT by rotating in the direction of the arrow A.

Among the plural rollers 32 illustrated in FIG. 1, the roller 32T serves as a tension-applying roller that applies tension to the transfer belt 31. Among the plural rollers 32 illustrated in FIG. 1, the roller 32B serves as a counter roller for the second-transfer roller 34. The counter roller 32B is provided at the obtuse vertex, i.e., the lower end, of the transfer belt 31 having the inverted obtuse-triangular shape. The transfer belt 31 is in contact with the photoconductor drums 21 for the respective colors from below at the base, i.e., the upper side, extending in the apparatus-width direction.

First-Transfer Rollers 33

The first-transfer rollers 33 are rollers that transfer the toner images on the respective photoconductor drums 21 to the transfer belt 31. As illustrated in FIG. 1, the first-transfer rollers 33 are provided on the inner side of the transfer belt 31 and across the transfer belt 31 from the respective photoconductor drums 21. A first-transfer voltage of the polarity opposite to the polarity of the toner is applied to each of the first-transfer rollers 33 from a power-feeding unit 37 (see FIG. 2). With the application of the first-transfer voltage, the toner images on the respective photoconductor drums 21 are transferred to the transfer belt 31 at respective first-transfer positions T each defined between a corresponding one of the photoconductor drums 21 and a corresponding one of the first-transfer rollers 33.

Second-Transfer Roller 34

The second-transfer roller 34 transfers the toner images superposed on the transfer belt 31 to the continuous-form paper P. As illustrated in FIG. 1, the second-transfer roller 34 is provided such that the transfer belt 31 is held between the second-transfer roller 34 and the counter roller 32B. The second-transfer roller 34 and the transfer belt 31 are in contact with each other under a predetermined load. The nip between the second-transfer roller 34 and the transfer belt 31 that are in contact with each other is defined as the second-transfer position NT. The second-transfer position NT is supplied with the continuous-form paper P transported from the feed roller 51. The second-transfer roller 34 rotates clockwise in FIG. 1.

Furthermore, a negative voltage is applied to the counter roller 32B from an application unit (not illustrated). Therefore, a potential difference is produced between the counter roller 32B and the second-transfer roller 34. Since the negative voltage is applied to the counter roller 32B, a second-transfer voltage (a positive voltage) of the polarity opposite to that of the toner is indirectly applied to the second-transfer roller 34, which serves as a counter electrode for the counter roller 32B. Thus, a transfer electric field is generated between the counter roller 32B and the second-transfer roller 34, and an electrostatic force acts on the toner images on the transfer belt 31. Consequently, the toner images on the transfer belt 31 are transferred to the continuous-form paper P passing through the second-transfer position NT.

Featured Elements

Figure 3:
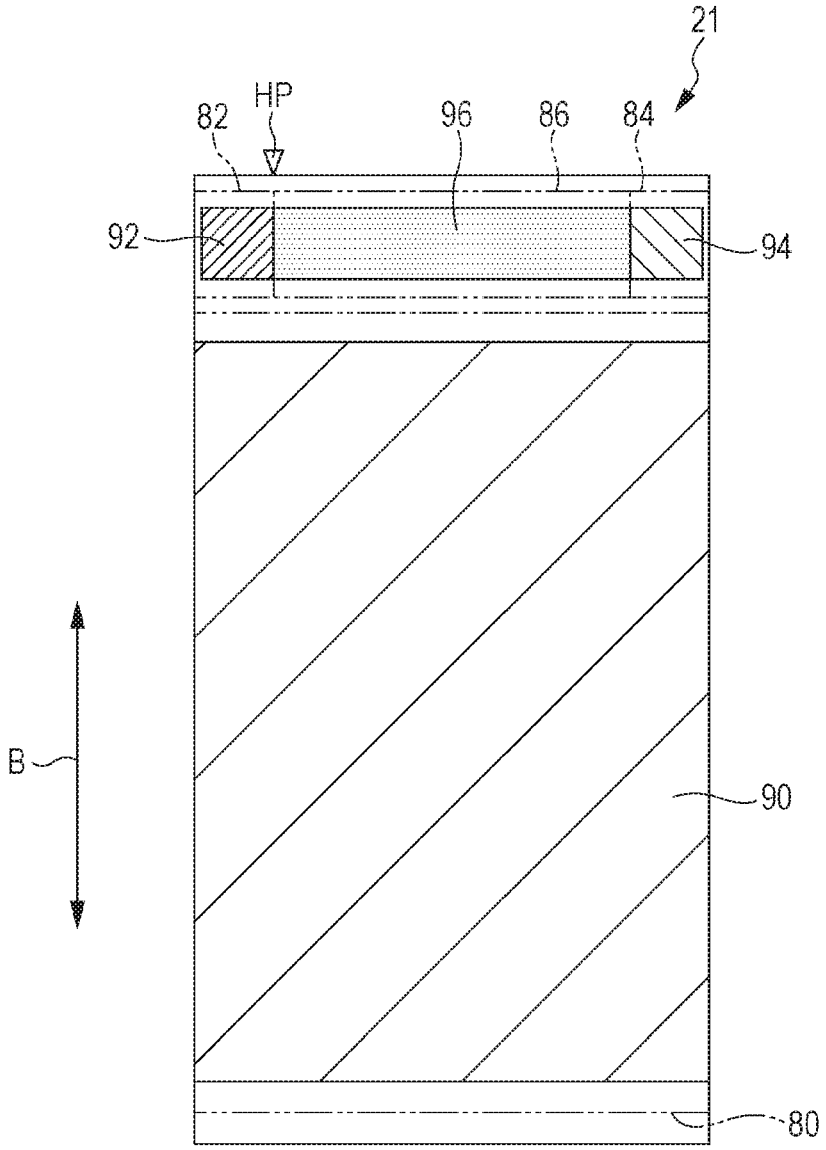
FIG. 3 is a development of a photoconductor drum according to the exemplary embodiment.
Figure 4:
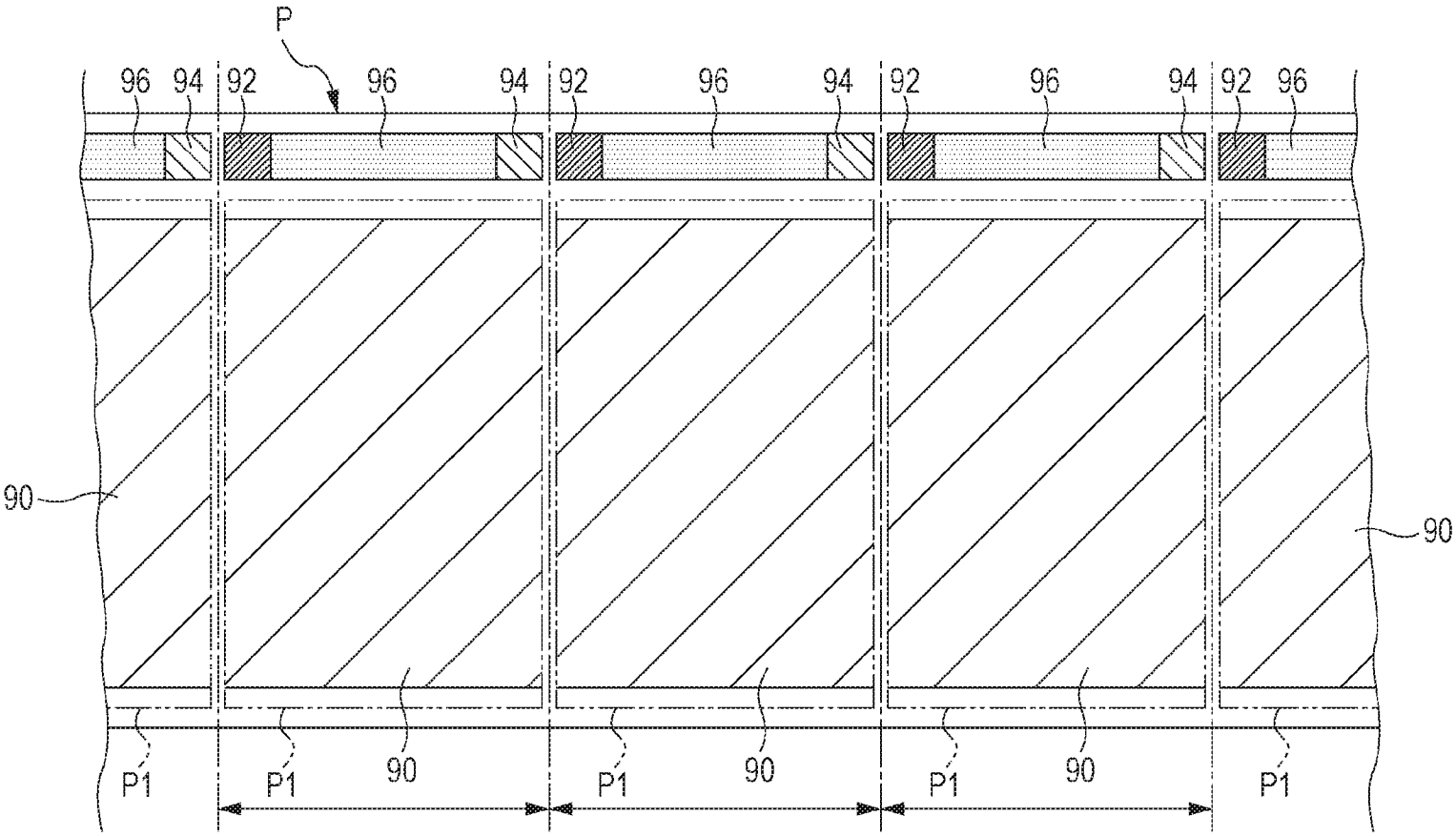
FIG. 4 is a schematic diagram illustrating transfer-object images, patches for color-misregistration detection, and patches for potential control that are formed on continuous-form paper in the exemplary embodiment.

FIG. 3 is a development of a representative one of the photoconductor drums 21 and illustrates the outer peripheral surface thereof. In FIG. 3, the axial direction of the photoconductor drum 21 is represented by an arrow B. As illustrated in FIG. 3, the toner image that is formed on the photoconductor drum 21 includes a transfer-object image 90, a patch 92 for color-misregistration detection, a patch 94 for potential control, and a band 96 for protection of the blade 25. The transfer-object image 90 is to be transferred to a transfer area P1 (see FIG. 4) of the continuous-form paper P.

The band 96 has a higher image density (a larger amount of toner per unit area) than the patches 92 and 94 and is formed on the photoconductor drum 21 more often than the patches 92 and 94.

The photoconductor drum 21 has patch areas 82 and 84 in which the patch 92 for color-misregistration detection and the patch 94 for potential control are to be formed, respectively, a band area 86 in which the band 96 for protection of the blade 25 is to be formed, and an image area 80 in which the transfer-object image 90 is to be formed.

The patch areas 82 and 84 and the band area 86 are provided at respective predetermined positions at a first axial end (the upper end in FIG. 3) of the photoconductor drum 21 and do not overlap the image area 80 in the axial direction of the photoconductor drum 21.

Specifically, the patch areas 82 and 84 and the band area 86 are at different positions in the peripheral direction of the photoconductor drum 21 but are at the same position in the axial direction of the photoconductor drum 21. The image area 80 is provided on a side nearer to a second axial end of the photoconductor drum 21 with respect to the patch areas 82 and 84 and the band area 86.

In the present exemplary embodiment, as illustrated in FIG. 3, a reference position HP is defined in the peripheral direction of the photoconductor drum 21. The patch areas 82 and 84 and the band area 86 are defined on the basis of, for example, the distance (or angle) from a reference position HP in the peripheral direction of the photoconductor drum 21. The reference position HP may be detected by, for example, a sensor. Alternatively, the angle of rotation of the photoconductor drum 21 may be detected by using a sensor, such as a rotary encoder, or on the basis of information, such as a driving pulse, so that the positions of the patch areas 82 and 84 and the band area 86 are recognized.

In the present embodiment, as illustrated in FIG. 1, a detection sensor 72 (an exemplary detecting unit) that detects the patch 92 for color-misregistration detection is provided at a position on the downstream side with respect to the toner-image-forming unit 20(K) and on the upstream side with respect to the second-transfer position NT in the direction of rotation of the transfer belt 31.

The detection sensor 72 detects the patches 92 included in the respective toner images on the transfer belt 31, whereby any misregistration of the toner images in the respective colors on the transfer belt 31 is detected. On the basis of the result of the detection, the controller 70 controls the positions of images to be formed on the respective photoconductor drums 21, as exemplary conditions for image formation.

Figure 2:
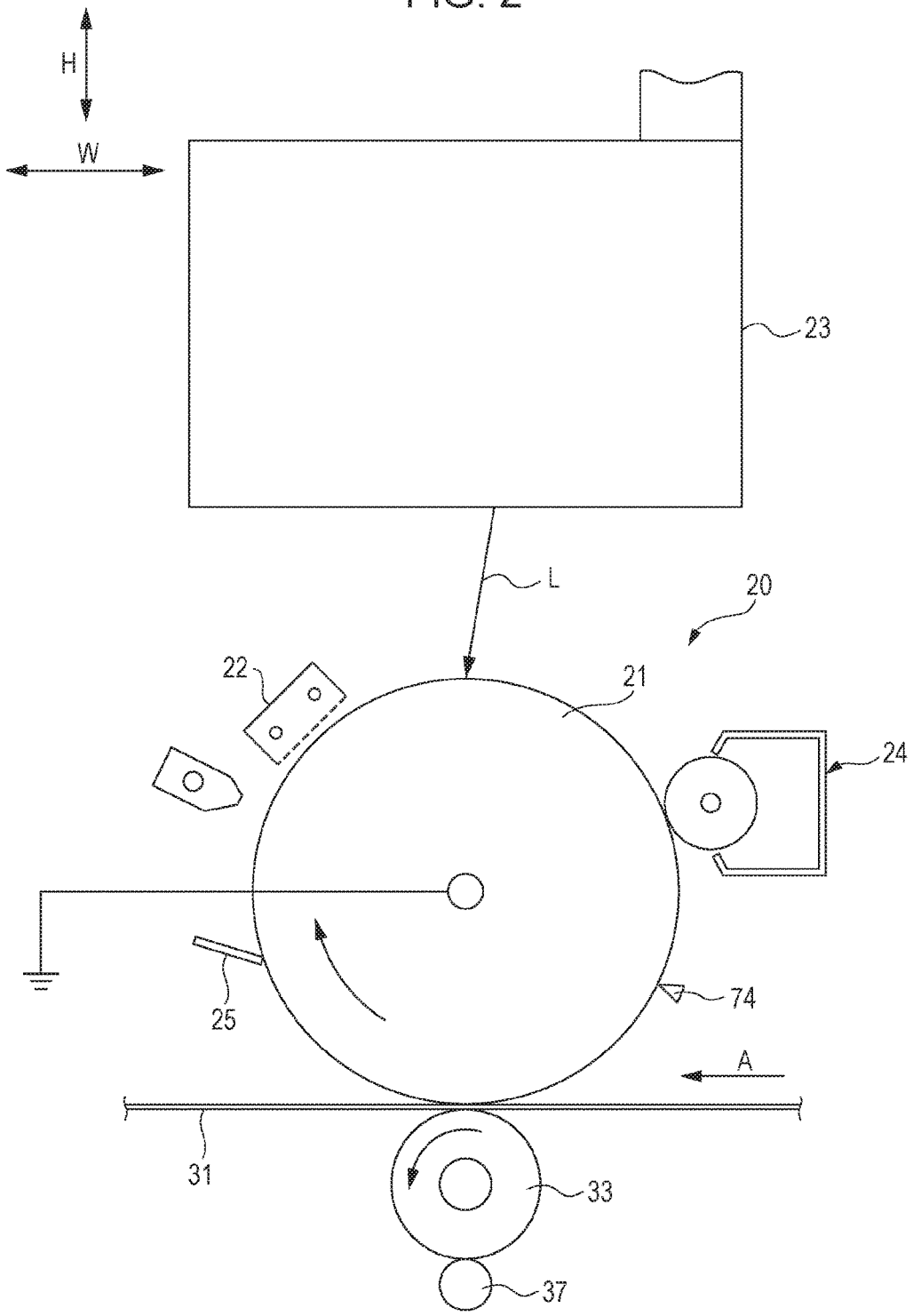
FIG. 2 is a schematic diagram of a toner-image-forming unit according to the exemplary embodiment.

Referring now to FIG. 2, a detection sensor 74 (another exemplary detecting unit) that detects the patch 94 for potential control is provided to each of the photoconductor drums 21 at a position on the downstream side with respect to the developing device 24 and on the upstream side with respect to the first-transfer position T in the direction of rotation of the photoconductor drum 21.

The detection sensor 74 detects the density of the patch 94. Then, the controller 70 controls the levels of charging potential, exposure potential, and development potential (exemplary conditions for image formation) such that the detected density is adjusted to a predetermined target density.

Note that the patch 94 for potential control is formed at the first axial end of the photoconductor drum 21. The levels of charging potential, exposure potential, and development potential are controlled on the premise that the image density at the first axial end of the photoconductor drum 21 is substantially the same as those in an axially central part and at the second axial end of the photoconductor drum 21.

Toner particles forming the band 96 for protection of the blade 25 are fed to a position between the photoconductor drum 21 and the blade 25 with the rotation of the photoconductor drum 21. Therefore, the friction between the blade 25 and the photoconductor drum 21 is reduced. Thus, the blade 25 is protected.

The patches 92 and 94 and the band 96 transferred from the photoconductor drum 21 to the transfer belt 31 are further transferred to a first widthwise end (an end in a direction orthogonal to the longitudinal direction) of the continuous-form paper P. That is, the patches 92 and 94 and the band 96 are transferred to neither a position between adjacent ones of the transfer areas P1 that are side by side in the longitudinal direction of the continuous-form paper P nor a position in any of the transfer areas P1.

Thus, the patches 92 and 94 serve as exemplary first images that are not transferred to the transfer area P1 but are detected by the respective detection sensors 72 and 74 (exemplary detecting units) so as to be used in an operation of controlling the conditions for image formation.

The band 96 is not transferred to the transfer area P1 but serves as an exemplary second image, which is not used in the operation of controlling the conditions for image formation. The phrase "not used in the operation of controlling the conditions for image formation" does not imply that the result of detection of the second image is not used in any operation of controlling (adjusting) the conditions for image formation, but implies that the density of the second image is not detected by the detection sensors 72 and 74 (exemplary detecting units) or that the density of the second image is detected by the detection sensors 72 and 74 but is not used in the operation of controlling the conditions for image formation.

Functions of Exemplary Embodiment

Functions of the present exemplary embodiment will now be described in comparison with functions of a comparative example.

As a comparative example, suppose that the patch 94 for potential control and the band 96 for protection of the blade 25 are formed in the same arbitrary area at the first axial end of the photoconductor drum 21. More specifically, the patch 94 and the band 96 provided at the first axial end of the photoconductor drum 21 are at the same position in the axial direction and in the peripheral direction of the photoconductor drum 21 and are formed alternately with every revolution of the photoconductor drum 21. That is, for example, after the band 96 having been formed at a specific position is erased, the patch 94 is formed at that position.

In such a case where the patch 94 and the band 96 are alternately formed in the same area at the first axial end of the photoconductor drum 21, adhesion of toner particles to that area and removal of toner particles with the blade 25 from that area are performed repeatedly. Such a situation may lead to a reduction in the sensitivity of the photoconductor drum 21 or an increase in the potential of the photoconductor drum 21 in that area.

Consequently, the result of detection of the patch 94 by the detection sensor 74 may deviate from the characteristics, such as sensitivity and potential, in the axially central part of the photoconductor drum 21. In such an event, even if conditions such as the levels of charging potential, exposure potential, and development potential are controlled by the controller 70 on the basis of the result of detection of the patch 94 by the detection sensor 74, the conditions are not controlled appropriately.

In contrast, according to the present exemplary embodiment, the patch area 84 and the band area 86 provided at the first axial end (the upper end) of the photoconductor drum 21 are at different positions in the peripheral direction of the photoconductor drum 21.

Furthermore, according to the present exemplary embodiment, the patch area 84 and the band area 86 are provided at different positions in the peripheral direction of the photoconductor drum 21. Therefore, even if the patch area 84 and the band area 86 are provided at the same position in the axial direction of the photoconductor drum 21 as in the present exemplary embodiment, there is no chance that the patch 94 and the band 96 may be formed in the same area. According to the exemplary embodiment, since the patch area 84 and the band area 86 are provided at the same position in the axial direction of the photoconductor drum 21, the patch area 84 and the band area 86 are allowed to be provided within an area having a short length in the axial direction of the photoconductor drum 21 at the first end of the photoconductor drum 21.

Modifications

While the above exemplary embodiment concerns a case where the patch areas 82 and 84 and the band area 86 are provided at the first axial end (the upper end in FIG. 3) of the photoconductor drum 21 and at different positions in the peripheral direction of the photoconductor drum 21, the present invention is not limited to such a case.

Figure 5:
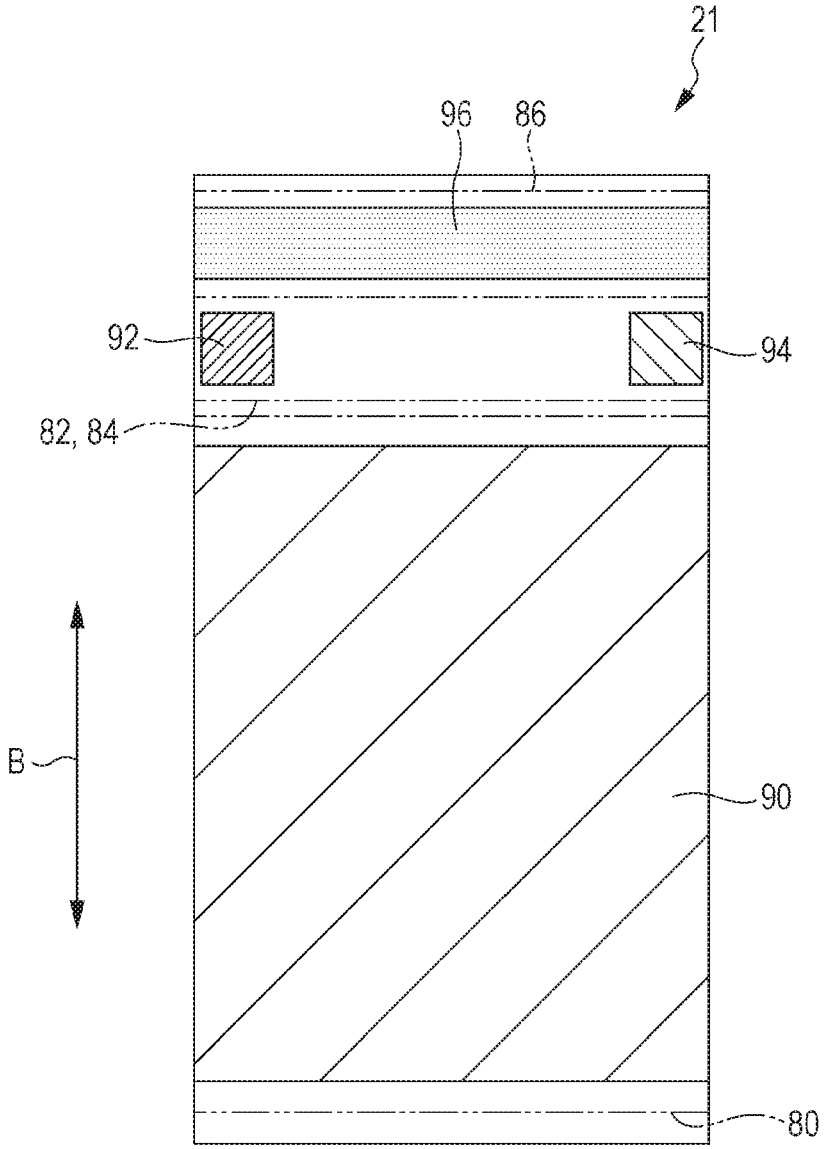
FIG. 5 is a development of a photoconductor drum according to a modification of the exemplary embodiment.

Referring to FIG. 5, the patch areas 82 and 84 and the band area 86 provided at the first axial end (the upper end in FIG. 5) of the photoconductor drum 21 may be at different positions in the axial direction of the photoconductor drum 21. In a modification illustrated in FIG. 5, the patch area 82 also serves as the patch area 84, and vice versa. That is, in the modification illustrated in FIG. 5, after the patch 92 having been formed at a specific position is erased, the patch 94 may be formed at that position.

In such a modification, the area over which the patch areas 82 and 84 are expected to extend in the axial direction of the photoconductor drum 21 only needs to be detected by the detection sensors 72 and 74. Hence, in the above modification, the patch 94 and the band 96 are allowed to be shifted in the peripheral direction of the photoconductor drum 21 within a predetermined area.

Figure 6:
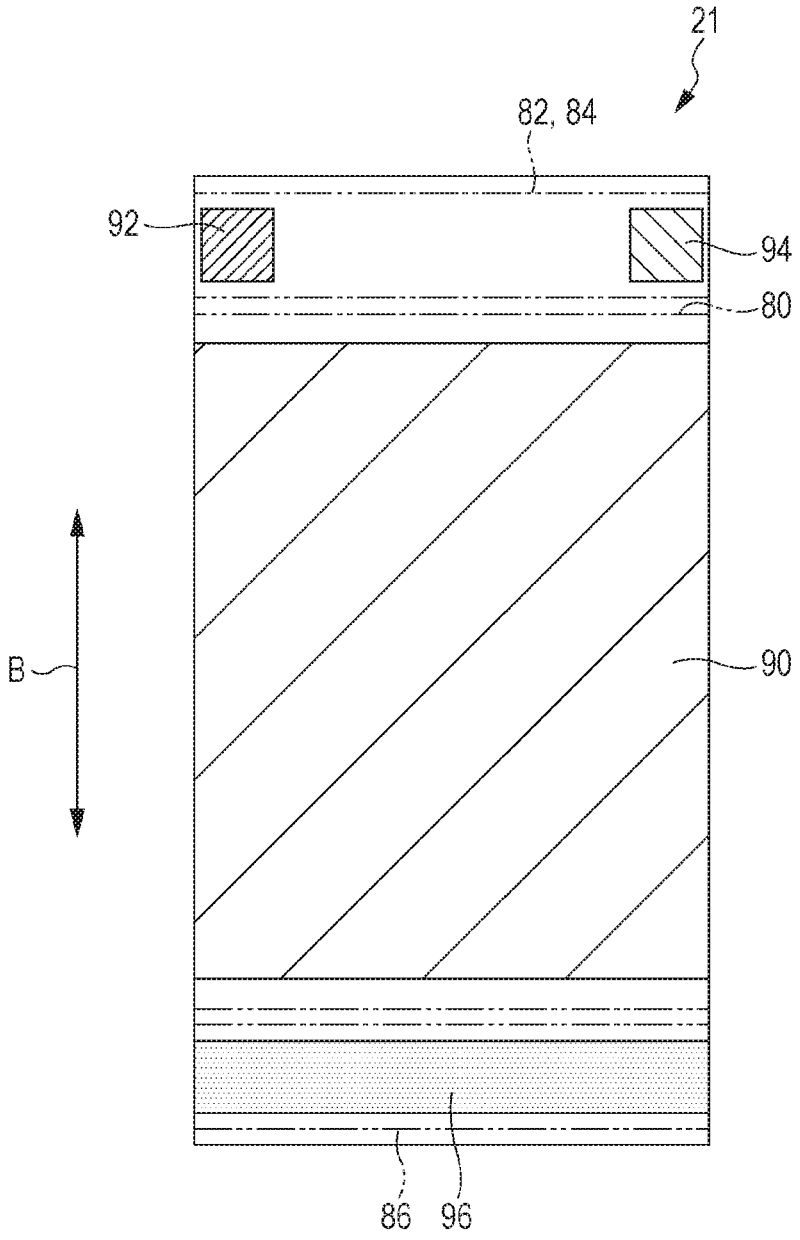
FIG. 6 is a development of a photoconductor drum according to another modification of the exemplary embodiment.

FIG. 6 illustrates another modification in which the patch areas 82 and 84 and the band area 86 are provided at different positions in the axial direction of the photoconductor drum 21. In the modification illustrated in FIG. 6, the patch areas 82 and 84 are provided at the first axial end (the upper end in FIG. 6) of the photoconductor drum 21, whereas the band area 86 is provided at the second axial end of the photoconductor drum 21. In addition, the patch area 82 also serves as the patch area 84, and vice versa.

Furthermore, while the above exemplary embodiment concerns a case where the patch 92 for color-misregistration detection and the patch 94 for potential control are employed as the first images, the present invention is not limited to such a case. For example, the first image may be a gradation patch for adjustment of the gradation of each of the colors.

Furthermore, while the above exemplary embodiment concerns a case where the band 96 for protection of the blade 25 is employed as the second image, the present invention is not limited to such a case. For example, the second image may be a band for consumption of deteriorated developer (toner particles).

Furthermore, while the above exemplary embodiment concerns a case where the patches 92 and 94 and the band 96 are transferred to the continuous-form paper P, the present invention is not limited to such a case. For example, the first image and the second image may be retained on the transfer belt 31 and be removed by a cleaning device or the like, instead of being transferred from the transfer belt 31 to the continuous-form paper P.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photosensitive member having an image area, a first area, and a second area, the first and second areas being provided at different predetermined positions, respectively, at an axial end of the photosensitive member, the first and second areas not overlapping the image area in an axial direction of the photosensitive member;

a detecting unit configured to detect an image; and a forming unit configured to form a transfer-object image in the image area of the photosensitive member, the transfer-object image being transferred to a transfer area of continuous-form paper, the forming unit further being configured to form a first image in the first area of the photosensitive member and a second image in the second area of the photosensitive member, the first image not being transferred to the transfer area of the continuous-form paper, the first image being detected by the detecting unit and being used in an operation of controlling conditions for image formation, the second image not being transferred to the transfer area of the continuous-form paper and not being used in the operation of controlling the conditions for image formation.

2. The image forming apparatus according to claim 1, wherein the first area and the second area are provided at different predetermined positions, respectively, in the axial direction of the photosensitive member.

3. The image forming apparatus according to claim 1, wherein the first area and the second area are provided at different predetermined positions, respectively, in a peripheral direction of the photosensitive member.

4. The image forming apparatus according to claim 1, wherein the second image has a higher image density than that of the first image.

5. The image forming apparatus according to claim 1, wherein the first image comprises a first patch for color misregistration detection and a second patch for potential control.

6. The image forming apparatus according to claim 1, wherein the first area is provided at a first position, wherein the second area is provided at a second position, and wherein the first position and the second position are determined according to a predetermined reference position, the predetermined reference position being fixed with respect to the photosensitive member.

7. The image forming apparatus according to claim 6, further comprising a sensor configured to detect the predetermined reference position.

8. The image forming apparatus according to claim 6, further comprising a rotary encoder configured to detect an angle of rotation of the photosensitive member, wherein the predetermined reference position is provided at a predetermined fixed angle of rotation of the photosensitive member.

9. The image forming apparatus according to claim 6, wherein the predetermined reference position is provided at a predetermined fixed angle of rotation of the photosensitive member, and wherein the predetermined fixed angle of rotation of the photosensitive member is determined on the basis of a driving pulse.

10. The image forming apparatus according to claim 1, wherein the second image comprises a blade protection band.

* * * * *